US009062402B2

(12) United States Patent
Mizuno et al.

(10) Patent No.: US 9,062,402 B2
(45) Date of Patent: Jun. 23, 2015

(54) SEWING MACHINE MODULE AND SEWING MACHINE

(71) Applicants: Kenichi Mizuno, Nagoya (JP); Katsuhisa Hasegawa, Kasugai (JP); Shin Ota, Inazawa (JP)

(72) Inventors: Kenichi Mizuno, Nagoya (JP); Katsuhisa Hasegawa, Kasugai (JP); Shin Ota, Inazawa (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 243 days.

(21) Appl. No.: 13/788,727

(22) Filed: Mar. 7, 2013

(65) Prior Publication Data

US 2013/0255554 A1 Oct. 3, 2013

(30) Foreign Application Priority Data

Mar. 28, 2012 (JP) ..... 2012-072930

(51) Int. Cl.
*D05B 73/00* (2006.01)
*D05B 27/02* (2006.01)
*D05B 57/00* (2006.01)

(52) U.S. Cl.
CPC ..... *D05B 73/00* (2013.01); *D05B 27/02* (2013.01); *D05B 57/00* (2013.01)

(58) Field of Classification Search
CPC ..... D05B 73/00
USPC ..... 112/258, 14, 38, 90, 95, 106, 470.03, 112/470.14, 470.18, 318, 323, 220, 463, 112/232
See application file for complete search history.

(56) References Cited

U.S. PATENT DOCUMENTS

| | | | | |
|---|---|---|---|---|
| 4,512,273 | A * | 4/1985 | Skogward | 112/315 |
| 5,313,900 | A * | 5/1994 | Rendahl et al. | 112/316 |
| 5,549,062 | A * | 8/1996 | Yamashita et al. | 112/220 |
| 8,245,656 | B2 * | 8/2012 | Mori et al. | 112/456 |

FOREIGN PATENT DOCUMENTS

| | | |
|---|---|---|
| EP | 2 357 273 A1 | 8/2011 |
| JP | A-2002-273081 | 9/2002 |
| JP | A-2003-284882 | 10/2003 |

* cited by examiner

*Primary Examiner* — Tsjash Patel
(74) *Attorney, Agent, or Firm* — Oliff PLC

(57) ABSTRACT

A sewing machine module mounted in a sewing machine that includes a feed mechanism, a shuttle mechanism, a frame that covers at least a portion of a side face of the feed mechanism, a portion of a side face of the shuttle mechanism, a portion of a bottom face of the feed mechanism, and a portion of a bottom face of the shuttle mechanism and that supports the feed mechanism and the shuttle mechanism in a state in which a top side of the feed mechanism and a top side of the shuttle mechanism are open, a cover member that is formed into a flat plate shape and that covers the top side of the feed mechanism and the top side of the shuttle mechanism that are supported by the frame, and a joining mechanism that joins the frame and the cover member.

7 Claims, 7 Drawing Sheets

SEWING MACHINE MODULE AND SEWING MACHINE

CROSS-REFERENCE TO RELATED APPLICATION

This application claims priority from Japanese Patent Application No. 2012-072930, filed on Mar. 28, 2012, the content of which is hereby incorporated by reference.

BACKGROUND

The present disclosure relates to a sewing machine module that is provided with a feed mechanism and a shuttle mechanism, and to a sewing machine that is provided with the sewing machine module.

Cases are known in which a sewing machine module that has been manufactured such that the sewing machine module combines a plurality of mechanisms is mounted on a sewing machine in order to improve the production efficiency of the sewing machine. For example, the sewing machine module is manufactured by attaching a feed mechanism and a shuttle mechanism to a base plate.

The sewing machine module must be provided with high rigidity. In a known sewing machine module, the rigidity of the sewing machine module is ensured by bending a metal plate with high rigidity into a complex shape to form the base plate. Members that configure the feed mechanism and the shuttle mechanism are attached to the formed base plate from various directions.

SUMMARY

However, the process by which the base plate is formed by bending and the process by which the members are attached to the base plate from various directions are both complicated processes. Therefore, with the known technology, it is difficult to manufacture a sewing machine module that is provided with high rigidity.

The present disclosure provides a sewing machine module that is provided with high rigidity and can be manufactured easily, and also provides a sewing machine that is provided with the sewing machine module.

A sewing machine module mounted in a sewing machine according to a first aspect of the present disclosure includes a feed mechanism, a shuttle mechanism, a frame, a cover member, and a joining mechanism. The frame covers at least a portion of a side face of the feed mechanism, a portion of a side face of the shuttle mechanism, a portion of a bottom face of the feed mechanism, and a portion of a bottom face of the shuttle mechanism. The frame supports the feed mechanism and the shuttle mechanism in a state in which a top side of the feed mechanism and a top side of the shuttle mechanism are open. The cover member is formed into a flat plate shape and covers the top side of the feed mechanism and the top side of the shuttle mechanism that are supported by the frame. The joining mechanism joins the frame and the cover member.

A sewing machine according to a second aspect of the present disclosure includes a sewing machine module. The sewing machine module includes a feed mechanism, a shuttle mechanism, a frame a cover member, and a joining mechanism. The frame covers at least a portion of a side face of the feed mechanism, a portion of a side face of the shuttle mechanism, a portion of a bottom face of the feed mechanism, and a portion of a bottom face of the shuttle mechanism. The frame supports the feed mechanism and the shuttle mechanism in a state in which a top side of the feed mechanism and a top side of the shuttle mechanism are open. The cover member is formed into a flat plate shape and covers the top side of the feed mechanism and the top side of the shuttle mechanism that are supported by the frame. The joining mechanism joins the frame and the cover member. The sewing machine module is mounted in a sewing machine casing of the sewing machine in a state in which the frame and the cover member are joined by the joining mechanism.

BRIEF DESCRIPTION OF THE DRAWINGS

Embodiments of the invention will be described below in detail with reference to the accompanying drawings in which.

DETAILED DESCRIPTION OF THE EXEMPLARY EMBODIMENTS

Hereinafter, an embodiment of the present disclosure will be explained with reference to the drawings. Note that the drawings are used for explaining technological features that the present disclosure can utilize, and the drawings are not drawings whose purpose is to restrict the nature of the present disclosure. First, a physical configuration of a sewing machine 1 will be explained with reference to FIG. 1. In the explanation that follows, the lower left side, the upper right side, the upper left side, and the lower right side in FIG. 1 respectively define the left side, the right side, the rear side, and the front side of the sewing machine 1.

Figure 1:
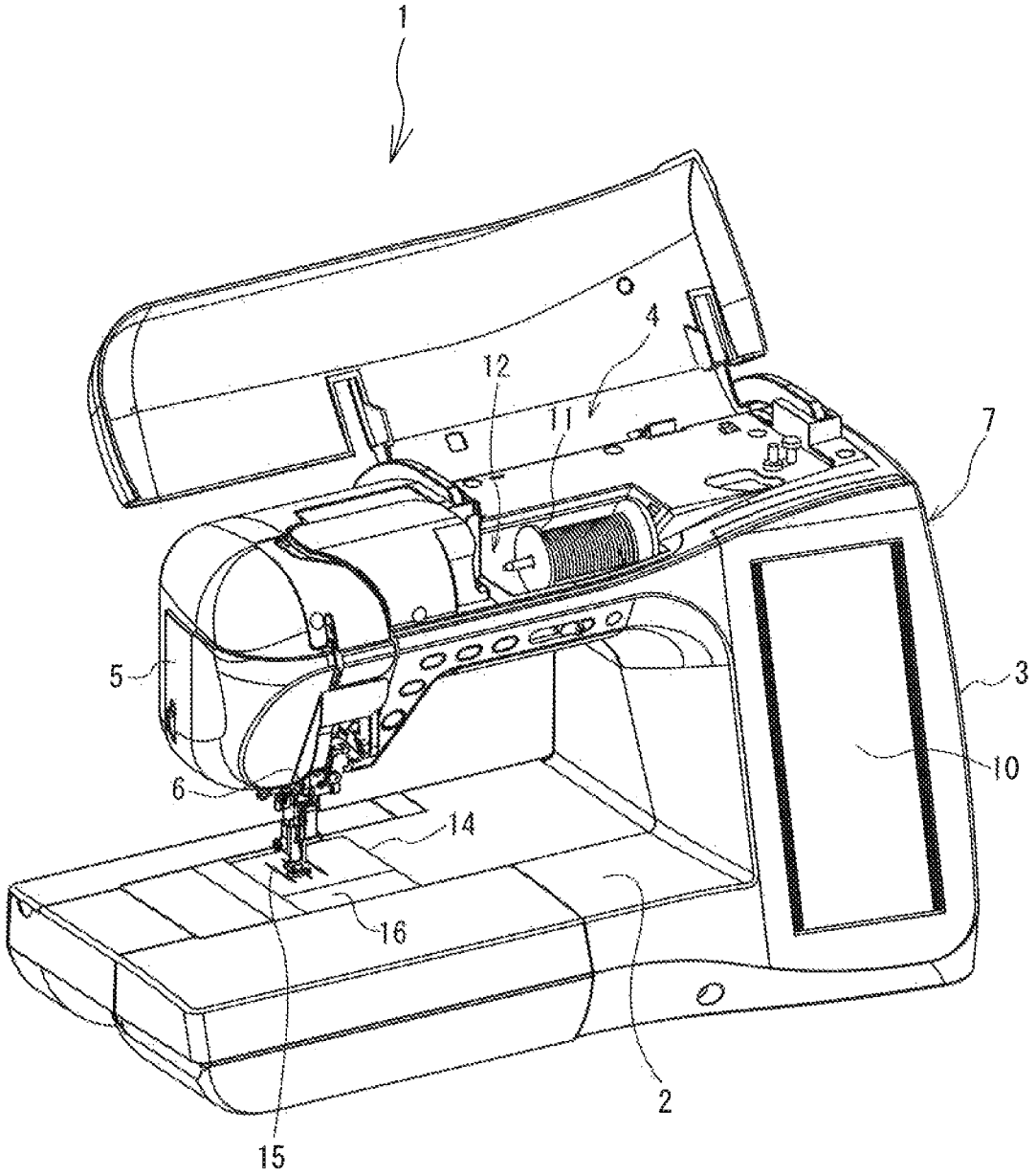
FIG. 1 is a perspective view of a sewing machine 1.

As shown in FIG. 1, a sewing machine casing 7 of the sewing machine 1 includes a bed 2, a pillar 3, an arm 4, and a head 5. The bed 2 is a base portion of the sewing machine 1 and extends in the left-right direction. The pillar 3 extends upward from the right end of the bed 2. A liquid crystal display (LCD) 10 is provided on the front face of the pillar 3. A touch panel is provided on a surface of the LCD 10. The arm 4 extends to the left from the upper end of the pillar 3, such that the arm 4 is opposite the bed 2. A drive shaft (not shown in the drawings) that extends in the left-right direction is contained in the interior of the arm 4. A spool mounting portion 12, on which a spool 11 that is used in sewing is mounted, is formed in the upper portion of the arm 4. The head 5 is provided on the left end of the arm 4 and is provided with a needle bar 6 and the like.

A needle plate 14 and a needle plate cover 16 that can be opened and closed are provided on the top face of the bed 2. A sewing machine module 8 (refer to FIG. 2 and the like) is mounted inside the bed 2 underneath the needle plate 14. As will be explained in detail later, the sewing machine module 8 is provided with a feed mechanism 60, a shuttle mechanism 90, and a lower shaft 50. The feed mechanism 60 moves a sewn object (for example, a cloth). The shuttle mechanism 90 grips an upper thread. The lower shaft 50 transmits a rotational force of a sewing machine motor (described later) to the feed mechanism 60 and the shuttle mechanism 90. A rectangular hole 15 into which and from which a feed dog 69 (refer to FIGS. 2 to 4 and the like) rises and descends is formed in the needle plate 14. When the feed dog 69 is in a state in which it is protruding upward from the rectangular hole 15 and is engaged with the sewn object, the feed dog 69 moves the sewn object by moving horizontally.

The sewing machine motor (not shown in the drawings) is provided underneath the interior of the pillar 3. The sewing machine motor rotates the drive shaft. When the drive shaft rotates, a needle bar up-and-down moving mechanism (not shown in the drawings) operates, the needle bar 6 moves up and down, and sewing is performed. The rotating of the drive shaft is transmitted to an intermediate shaft (not shown in the drawings) through a drive belt (not shown in the drawings). The intermediate shaft is supported in the interior of the bed 2 such that the intermediate shaft can rotate. The intermediate shaft is coupled to and rotates as a single unit with the lower shaft 50.

Figure 2:
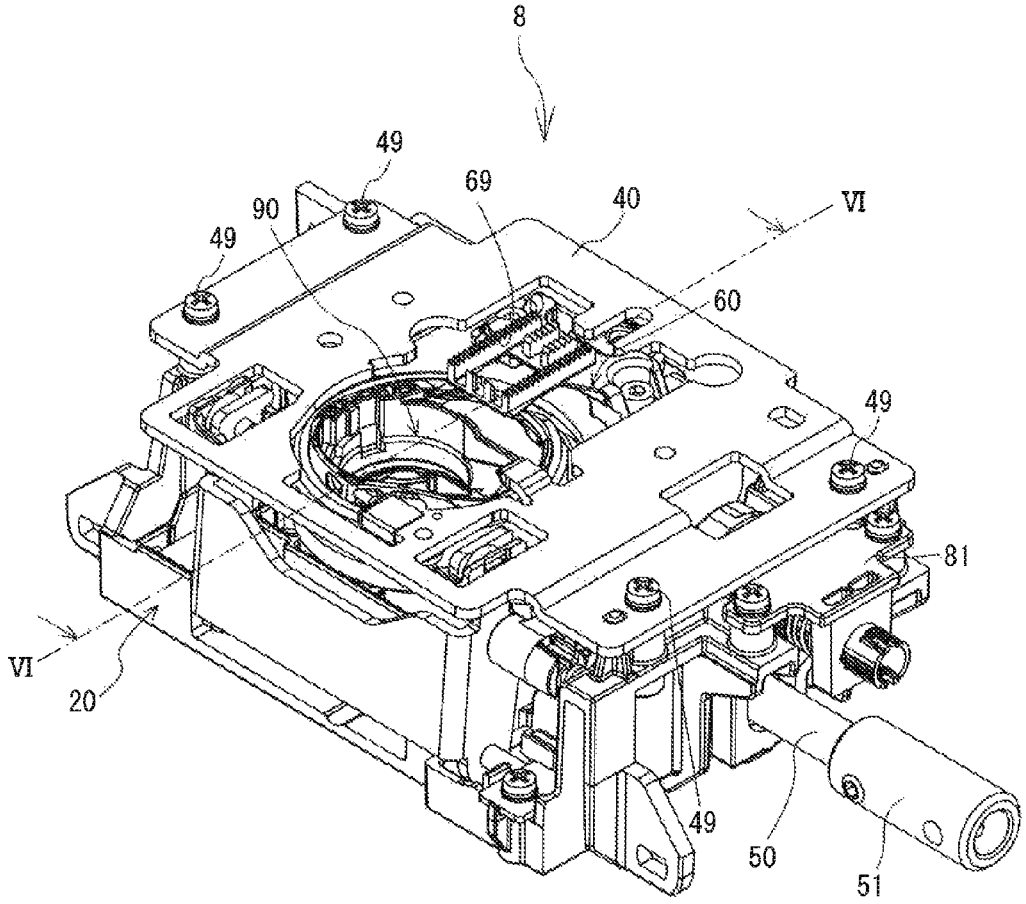
FIG. 2 is a perspective view of a sewing machine module 8.
Figure 3:
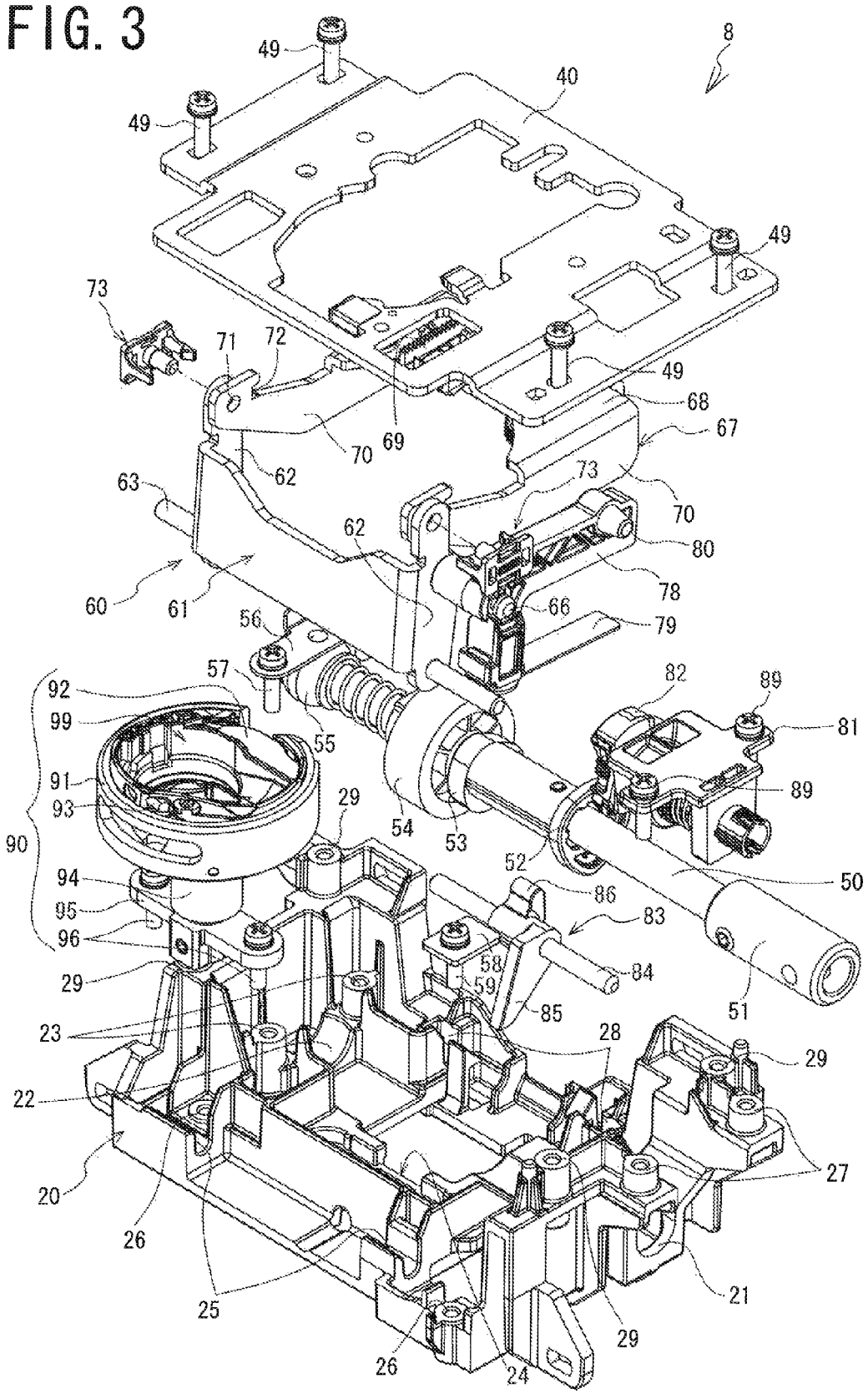
FIG. 3 is a perspective exploded view of the sewing machine module 8.

Hereinafter, the sewing machine module 8 will be explained. The lower left side, the upper right side, the upper left side, and the lower right side in FIGS. 2 and 3 respectively define the front side, the rear side, the left side, and the right side of the sewing machine module 8. As shown in FIGS. 2 and 3, the sewing machine module 8 is structured such that the feed mechanism 60, the shuttle mechanism 90, the lower shaft 50, and the like are integrated into a single unit by a frame 20 and a cover member 40. The sewing machine module 8 can therefore be mounted in the sewing machine 1 more easily than in a case where the feed mechanism 60, the shuttle mechanism 90, and the like are mounted separately in the sewing machine 1. Furthermore, the sewing machine module 8 is not limited to being mounted in the sewing machine 1 of the present disclosure, and the sewing machine module 8 can also be mounted in a plurality of types of sewing machines. Accordingly, production efficiency and maintenance efficiency are improved by the use of the sewing machine module 8.

The overall structure of the sewing machine module 8 will be explained. As shown in FIGS. 2 and 3, the frame 20 forms what is approximately a box shape and is open at a top side. The frame 20 covers the sides and the bottoms of the feed mechanism 60 and the shuttle mechanism 90. The feed mechanism 60, the shuttle mechanism 90, and the lower shaft 50 are attached to the frame 20 from the upper side of the frame 20. The cover member 40 is an approximately flat plate member and is joined to the frame 20 by four screws 49 on the open top side of the frame 20. The frame 20 and the cover member 40 will be described in detail later.

The lower shaft 50 will be explained. As shown in FIG. 3, the lower shaft 50 extends in the left-right direction. The lower shaft 50 is supported approximately in the center of the front-rear direction of the frame 20 such that the lower shaft 50 can rotate. In order starting from the right, the lower shaft 50 has a coupling portion 51, a front-rear feed cam 52, an up-down feed cam 53, a shuttle drive gear 54, and a bearing 55. The coupling portion 51 is positioned on the right end of the lower shaft 50. The coupling portion 51 couples the lower shaft 50 to the intermediate shaft (not shown in the drawings), which is supported inside the bed 2 such that the intermediate shaft can rotate. The front-rear feed cam 52 causes a feed bar 67 of the feed mechanism 60 to swing toward the front and toward the rear. The up-down feed cam 53 causes the feed bar 67 to swing upward and downward. The cam faces of the front-rear feed cam 52 and the up-down feed cam 53 are formed into smooth surfaces without any steps. The shuttle drive gear 54 is a helical gear, and rotates an outer shuttle 91 of the shuttle mechanism 90. The front-rear feed cam 52, the up-down feed cam 53, and the shuttle drive gear 54 are formed as a single unit that is made of a synthetic resin material, and are fixed to the lower shaft 50. The bearing 55 is located on the left end of the lower shaft 50 and supports the lower shaft 50 such that the lower shaft 50 can rotate. The bearing 55 is fixed to a bearing support portion 22 of the frame 20 by the screwing of two screws 57 of a lower shaft anchor plate 56 (only the screw 57 on the front side being shown in FIG. 3) into threaded holes 23 of the frame 20.

The shuttle mechanism 90 will be explained. As shown in FIG. 3, the shuttle mechanism 90 is provided with the outer shuttle 91, an inner shuttle 92, a gear 94, and a shuttle support portion 95. The outer shuttle 91 rotates in conjunction with the up-down movement of the needle bar 6 (refer to FIG. 1). The outer shuttle 91 has a hook point (not shown in the drawings) that grips the upper thread. The inner shuttle 92 is disposed on the inner side of the outer shuttle 91 and fits into the outer shuttle 91 such that the inner shuttle 92 can rotate. The inner shuttle 92 has a containing portion 99 that contains a bobbin (not shown in the drawings) around which a lower thread (not shown in the drawings) is wound. The inner shuttle 92 has a locking portion 93. The rotation of the inner shuttle 92 is restricted by the coming into contact of the locking portion 93 with a rotation-stopping member 42 of the cover member 40 (refer to FIG. 7). The gear 94 is a helical gear, and is provided such that the gear 94 extends below the lower edge of the outer shuttle 91. The outer shuttle 91 and the gear 94 rotate as a single unit. The outer shuttle 91 and the gear 94 are supported, such that the outer shuttle 91 and the gear 94 can rotate, by an outer shuttle shaft (not shown in the drawings) that is fixed to the shuttle support portion 95. The gear 94 engages with the shuttle drive gear 54, and when the shuttle drive gear 54 rotates, the gear 94 and the outer shuttle 91 rotate. The shuttle support portion 95 is fixed to the frame 20 by two screws 96.

Figure 4:
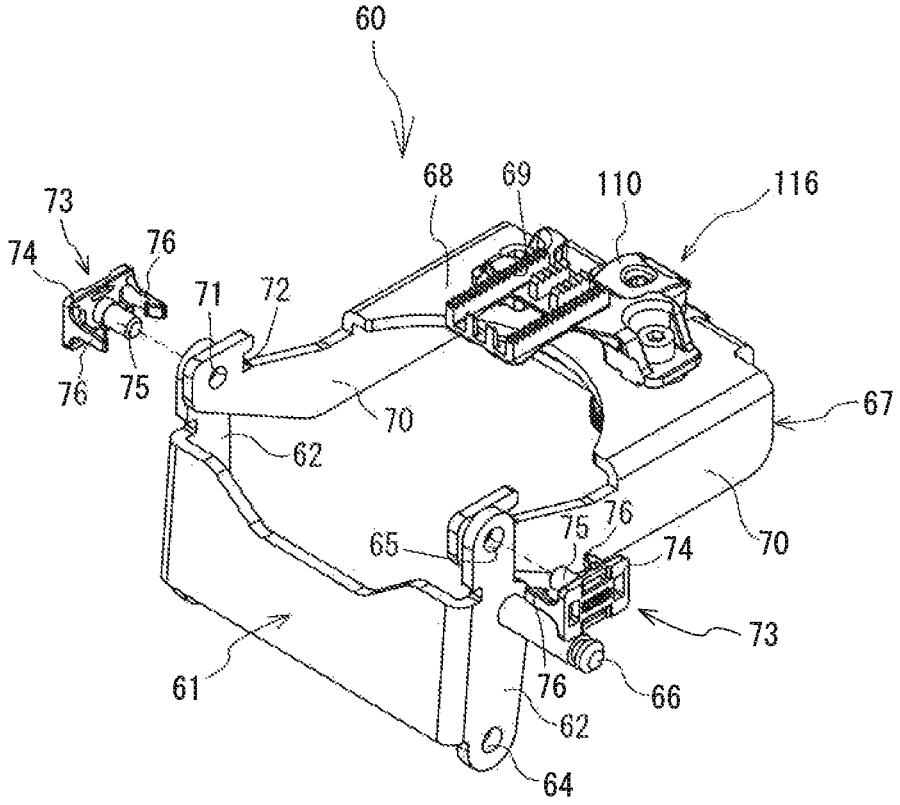
FIG. 4 is a perspective exploded view of a portion of a feed mechanism 60.

The feed mechanism 60 will be explained. As shown in FIG. 4, the feed mechanism 60 is mainly provided with a feed arm 61, the feed bar 67, and the feed dog 69.

The feed arm 61 has an approximately rectangular shape in a front view, and is formed from a metal plate. The left and right ends of the feed arm 61 are provided with flange portions 62 that are formed by being bent toward the rear. A hole 64, through which a support shaft 63 (refer to FIG. 3) is inserted, is formed in a lower edge portion of each of the flange portions 62. As will be described in detail later, the left and right ends of the support shaft 63 are fixed to the frame 20 by keep plates 58 and screws 59 (refer to FIG. 3). The feed arm 61 is supported such that the feed arm 61 can swing toward the front and toward the rear, with the support shaft 63, which has been inserted in the holes 64, serving as the center of rotation. A round hole 65 for coupling the feed arm 61 to the feed bar 67 is formed in an upper edge portion of each of the flange portions 62. A coupling shaft 66 extends toward the right from a position that is slightly higher than the center of the flange portion 62 on the right side. The coupling shaft 66 couples with a swivel link 78 (refer to FIG. 3) that will be described later.

The feed bar 67 includes a body portion 68 and a pair of beam portions 70. The body portion 68 is a plate-shaped portion that is disposed substantially horizontally. The feed dog 69 is fixed to the top face of the body portion 68. As will be described in detail later, an urging portion 116 for urging the feed bar 67 downward is provided in the center of the rear edge of the body portion 68 (to the rear of the feed dog 69). The pair of the beam portions 70 are each plate-shaped and extend parallel to one another toward the front from the left and right edges of the body portion 68. The distance between the pair of the beam portions 70 is slightly narrower than the distance between the pair of the flange portions 62. A round hole 71 for coupling the feed bar 67 to the feed arm 61 is provided in the tip of the front end of the each of the beam portions 70. The feed bar 67 and the feed arm 61 are coupled by coupling members 73 such that the feed bar 67 and the feed arm 61 can swing in relation to one another. Notches 72 for locking the coupling members 73 are formed to the rear of the holes 71 in the beam portions 70.

Figure 5:
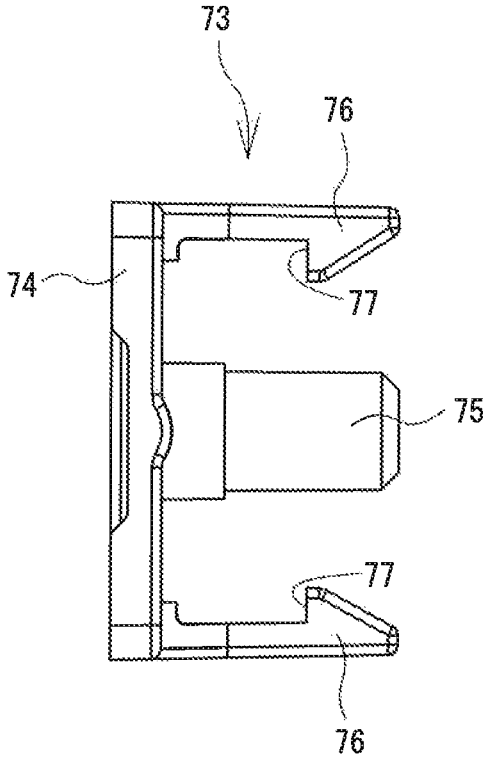
FIG. 5 is a plan view of a coupling member 73.

The coupling members 73 will be explained. The coupling members 73 are formed from a synthetic resin material that has flexibility. As shown in FIGS. 4 and 5, each of the coupling members 73 is provided with a base portion 74, a shaft portion 75, and a pair of locking portions 76. The base portion 74 is a rectangular plate-shaped member. The shaft portion 75 is a circular cylindrical shaft that extends orthogonally to the base portion 74 from the center of the plate face of the base portion 74. The diameter of the shaft portion 75 is slightly smaller than the diameters of the holes 65 in the feed arm 61 and the diameters of the holes 71 in the feed bar 67. The pair of the locking portions 76 extend parallel to one another from the left and right ends of the base portion 74 in the same direction in which the shaft portion 75 extends. The inner side of the tip of each of the locking portions 76 is slanted such that the inner side of the tip extends toward the inside as it gets closer to the base portion 74. A step portion 77 (refer to FIG. 5) is formed on the inner side of each of the locking portions 76 between the tip and the base portion 74.

In a case where the feed arm 61 and the feed bar 67 are coupled, as shown in FIG. 4, the positions of the holes 65 in the feed arm 61 are aligned by an operator to the positions of the holes 71 in the feed bar 67. Next, the shaft portions 75 of the coupling members 73 are inserted into the holes 65 and the holes 71 from the outer side. When the operator pushes on the coupling members 73, the shaft portions 75 are inserted into the holes 65 and the holes 71 as the pairs of the locking portions 76, which have flexibility, are deflected toward the outer side. When the step portions 77 (refer to FIG. 5) on each of the coupling members 73 reach the edges on the inner side of the corresponding beam portion 70, the deflecting of the pair of the locking portions 76 toward the outer side ceases, and the locking portions 76 are locked to the beam portion 70 by the pulling of the step portion 77 on one of the pair of the locking portions 76 into the notch 72 of the beam portion 70. The beam portions 70 and the flange portions 62 are thus sandwiched between the base portions 74 and the step portions 77 of the locking portions 76, such that the feed arm 61 and the feed bar 67 are coupled. The feed bar 67 can swing around the shaft portions 75. One of the locking portions 76 in each of the pairs of the locking portions 76 is locked to the notch 72 that is provided in the beam portion 70. Accordingly, the coupling members 73 rotate in conjunction with the swinging of the feed arm 61, and the locking of the locking portions 76 to the beam portions 70 is maintained. In a case where the coupling of the feed arm 61 and the feed bar 67 is released, the locking of the locking portions 76 to the beam portions 70 is also released, and the coupling can be released simply by pulling out the coupling members 73.

The structure that causes the feed dog 69 to move toward the front and toward the rear will be explained. As shown in FIG. 3, the coupling shaft 66 of the feed arm 61 supports the swivel link 78, which extends toward the rear, such that the swivel link 78 can rotate. A base end portion of a leaf spring 79 is fixed to a base end portion of the swivel link 78. In a side view, the swivel link 78, to which the leaf spring 79 is fixed, is shaped like the letter U turned on its side. The front-rear feed cam 52 is positioned between the swivel link 78 and the leaf spring 79. The leaf spring 79 is urged in the direction that presses the leaf spring 79 against the cam face of the front-rear feed cam 52. Therefore, the front-rear feed cam 52 is constantly in contact with the swivel link 78. A projecting portion 80 projects to the right from the free end of the swivel link 78.

The sewing machine module 8 is provided with a front-rear feed amount adjustment mechanism 81 that adjusts a feed amount in the front-rear direction. A feed adjuster 82 is provided on the left side of the front-rear feed amount adjustment mechanism 81. An engaging groove (not shown in the drawings) with which the projecting portion 80 of the swivel link 78 engages such that the swivel link 78 can slide is formed on a left side face of the feed adjuster 82. The feed adjuster 82 is supported in a way that allows its orientation to be changed such that the angle of the engaging groove changes. The angle of the engaging groove, that is, the orientation of the feed adjuster 82, is controlled by a feed amount setting mechanism (not shown in the drawings) that is provided in the interior of the sewing machine 1.

When the lower shaft 50 rotates, the swivel link 78 is swiveled up and down by the front-rear feed earn 52. The engaging groove of the feed adjuster 82 is inclined in relation to the vertical. The reciprocal up-and-down movement of the projecting portion 80 within the engaging groove of the feed adjuster 82 causes the coupling shaft 66, which supports the swivel link 78, to swing toward the front and toward the rear around the support shaft 63, which supports the feed arm 61. The feed bar 67 and the feed dog 69 thus swing toward the front and toward the rear. When the orientation of the feed adjuster 82 is changed, the angle of the engaging groove changes, so the amount that the coupling shaft 66 moves toward the front and toward the rear (that is, the feed amount for feeding toward the front and toward the rear) changes.

Figure 6:
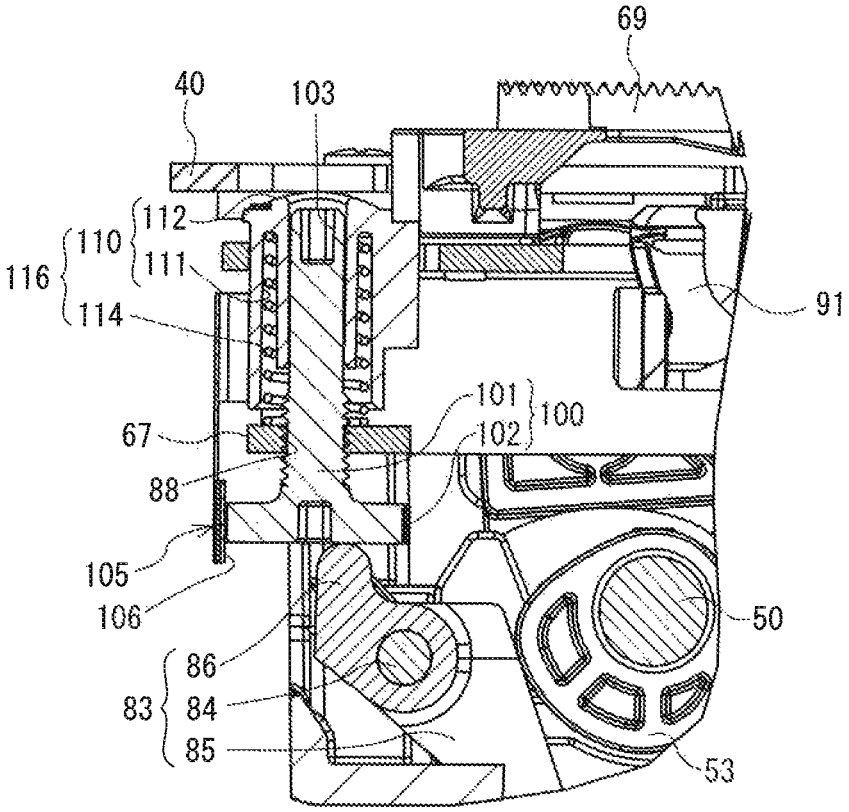
FIG. 6 is a figure that shows a portion of a section view along a line VI-VI in FIG. 2, as seen from the direction of the arrows in FIG. 2.

The mechanism that moves the feed dog 69 up and down will be explained. As shown in FIGS. 3 and 6, an up-down feed lever 83 is provided below the feed bar 67. The up-down feed lever 83 is provided with a pivot shaft 84, a cam contacting portion 85, and a screw contacting portion 86. The pivot shaft 84 extends in the left-right direction and supports the entire up-down feed lever 83 such that that up-down feed lever 83 can pivots. The left and right ends of the pivot shaft 84 are fixed to the frame 20 by screws (not shown in the drawings). The cam contacting portion 85 extends obliquely downward toward the front from a point that is slightly to the right of the center of the pivot shaft 84 in the left-right direction. A flat face on the front side of the cam contacting portion 85 comes into contact with the up-down feed cam 53. The screw contacting portion 86 projects upward from the rear side of the pivot shaft 84 in the center of the pivot shaft 84 in the left-right direction. The screw contacting portion 86 comes into contact with the lower end of an adjusting screw 100 (refer to FIG. 6) that will be described later.

As shown in FIG. 6, when the lower shaft 50, which is positioned below the feed bar 67, rotates, the up-down feed cam 53 causes the up-down feed lever 83 to pivot around the pivot shaft 84. When the up-down feed lever 83 pivots clockwise, as seen from the left side, the screw contacting portion 86 pushes the adjusting screw 100 upward. This causes the feed bar 67, which is connected to the adjusting screw 100, to swing upward. When the up-down feed lever 83 pivots counterclockwise, as seen from the left side, the position of the screw contacting portion 86 drops, so the feed bar 67 swings downward. The feed bar 67 is urged downward by the urging portion 116, which will be described later, so the up-down feed cam 53 and the cam contacting portion 85 of the up-down feed lever 83 are maintained in a state of contact. Accordingly, the feed bar 67 swings smoothly up and down.

The adjusting screw 100 and the urging portion 116 will be explained. As shown in FIG. 6, a threaded hole 88 that passes through the feed bar 67 in the up-down direction is formed in the rear edge portion of the feed bar 67. A threaded portion 101 of the adjusting screw 100 is screwed into the threaded hole 88 from below. The adjusting screw 100 is provided with the threaded portion 101 and a flange portion 102. A male thread that screws into the threaded hole 88 is formed on the threaded portion 101. The flange portion 102 has a round plate shape that is larger than the outside diameter of the threaded portion 101. The flange portion 102 is formed as a single unit with the threaded portion 101. Knurling (specifically, straight knurling) is formed on the outer circumferential face of the flange portion 102, although this is not shown in the drawings. In this case, "knurling" refers to a plurality of small ridges and grooves that are formed on the outer circumferential face of a circular cylindrical member. A hexagonal hole 103 is formed at the upper end of the threaded portion 101. It is possible to move the adjusting screw 100 in the axial direction (the up-down direction) of the threaded hole 88 by inserting a hexagonal wrench (not shown in the drawings) into the hexagonal hole 103 and turning the adjusting screw 100 against the urging force of a leaf spring 105 that will be described later. The distance between the up-down feed lever 83 and the feed bar 67 is adjusted by moving the adjusting screw 100. The positions of the feed bar 67 and the feed dog 69 in the up-down direction are thus adjusted.

The upper portion (the base end portion) of the leaf spring 105 is fixed to a portion of the feed bar 67 on the rear side of the adjusting screw 100. The lower portion (the free end portion) of the leaf spring 105 is urged toward the flange portion 102 of the adjusting screw 100. A projecting portion 106 is formed on the front side of the lower portion of the leaf spring 105. The projecting portion 106 restricts the rotating of the adjusting screw 100 by being in contact with the knurling (the ridges and grooves of the knurling) that is formed on the flange portion 102 of the adjusting screw 100. It is therefore possible to prevent the position of the feed bar 67 in the up-down direction from being changed by the unintentional rotating of the adjusting screw 100 by the operator. Because the outside diameter of the flange portion 102 is greater than the outside diameter of the threaded portion 101, the rotation of the adjusting screw 100 can be adequately restricted even if the urging force of the leaf spring 105 is made smaller.

A circular cylindrical spring cover 110 is fitted over the threaded portion 101 of the adjusting screw 100. A contact portion 112 on the upper end of the spring cover 110 has a curved shape that protrudes upward. Specifically, the contact portion 112 has a smoothly curved shape that, in a section view, protrudes upward in a direction that is orthogonal to the axial direction of the lower shaft 50 (the left-right direction). A ring-shaped slot 111 into which a compression spring (a coil spring) 114 is inserted from below is formed inside the spring cover 110. The inserting of the compression spring 114 into the slot 111 causes the spring cover 110 to cover the compression spring 114 from above (from the cover member 40 side). The lower end of the compression spring 114 is in contact with the top face of the feed bar 67. Therefore, the spring cover 110 is urged upward by the compression spring 114 toward the cover member 40. Because the spring cover 110 is fitted over the threaded portion 101, the up-and-down movement of the spring cover 110 is guided smoothly by the threaded portion 101.

The cover member 40 is mounted such that the cover member 40 covers the spring cover 110, the feed bar 67, and the like from above. Therefore, the bottom face of the cover member 40 is in contact with the contact portion 112 on the upper end of the spring cover 110. The urging portion 116 in which the spring cover 110 and the compression spring 114 are provided therefore urges the feed bar 67 downward, and the state of contact between the up-down feed cam 53 and the cam contacting portion 85 of the up-down feed lever 83 is maintained. Accordingly, the feed bar 67 swings up and down smoothly. In the feed mechanisms of the known sewing machines, the feed bar is generally urged downward by a tension spring. The tension spring must be installed between the feed bar and one of the frame and the machine casing that forms the bed, a task that is cumbersome. In the present embodiment, the operator simply mounts the cover member 40 from above, which completely eliminates the task of mounting the tension spring and dramatically improves the work efficiency.

The feed bar 67 is swung upward and downward, as well as toward the front and toward the rear, by the feed mechanism 60 (refer to FIG. 3). Therefore, in a case where the upper end of the compression spring 114 is in direct contact with the bottom face of the cover member 40, and the feed bar 67, with which the lower end of the compression spring 114 is in contact, swings, the compression spring 114 may fall, be damaged, or the like. However, in the present embodiment, the protruding, curved contact portion 112 of the spring cover 110 that covers the compression spring 114 makes contact with the bottom face of the cover member 40 at a single point. Therefore, even if the feed bar 67 swings in relation to the cover member 40, all that happens is that the position of the point where the contact portion 112 and the cover member 40 are in contact shifts, so the spring cover 110 does not tilt significantly in relation to the cover member 40. Falling and the like of the compression spring 114 is thus prevented. Furthermore, no damage is done to the bottom face of the cover member 40 by the compression spring 114.

The contact portion 112 on the upper end of the spring cover 110 has an upwardly protruding curved shape. Therefore, even if the feed bar 67 swings toward the front and toward the rear, as well as upward and downward, the spring cover 110 can slide smoothly against the cover member 40.

The frame 20 will be explained. The frame 20 is formed from a synthetic resin material. As described previously, the frame 20 forms what is approximately a box shape, with its top side open. As shown in FIG. 3, a U-shaped lower shaft insertion portion 21 that is open at the top is formed in the center of the right side face of the frame 20. The bearing support portion 22, which is recessed in the shape of a semicircular surface, is provided close to the left edge portion of the frame 20. The threaded holes 23 are formed in front of and to the rear of the bearing support portion 22. The lower shaft 50 is placed into the frame 20 from above. At that time, the lower shaft 50 is passed through the lower shaft insertion portion 21, and the bearing 55 is placed into the bearing support portion 22. Next, the screws 57 are screwed into the threaded holes 23 from above, fixing the lower shaft anchor plate 56 in place, such that the lower shaft 50 is easily mounted in the frame 20 from above.

A shuttle mounting portion 24 is formed close to the center of the bottom face of the frame 20. The shuttle mechanism 90 can be mounted in the frame 20 by screwing the screws 96 into threaded holes (not shown in the drawings) in the shuttle mounting portion 24 from above. U-shaped support shaft insertion portions 25 that are open at the top are formed close to the front edge of the frame 20 in two locations on the left and the right. The support shaft 63 of the feed mechanism 60 is placed into the support shaft insertion portions 25 from above. Next, the keep plates 58 (only the keep plate 58 on the right side being shown in FIG. 3) are fixed in place by the screwing of the screws 59 (only the screw 59 on the right side being shown in FIG. 3) into two threaded holes 26, each of which is provided close to one of the support shaft insertion portions 25. The support shaft 63 is thus fixed to the frame 20 from above.

Threaded holes 27 for fixing the front-rear feed amount adjustment mechanism 81 in place are formed in two locations close to the right edge of the frame 20. The front-rear feed amount adjustment mechanism 81 can easily be fixed in place in the frame 20 from above by screwing screws 89 into the two threaded holes 27 from above. U-shaped pivot shaft insertion portions 28 that are open at the top are formed close to the rear edge of the frame 20 in two locations on the left and the right. The pivot shaft 84 of the up-down feed lever 83 can easily be placed into the pivot shaft insertion portions 28 from above and fixed in place with screws (not shown in the drawings). Threaded holes 29 for fixing the cover member 40 are formed in four corners of the upper portion of the frame 20. The cover member 40 is joined to the frame 20 by the screwing of the screws 49 into the four threaded holes 29.

Figure 7:
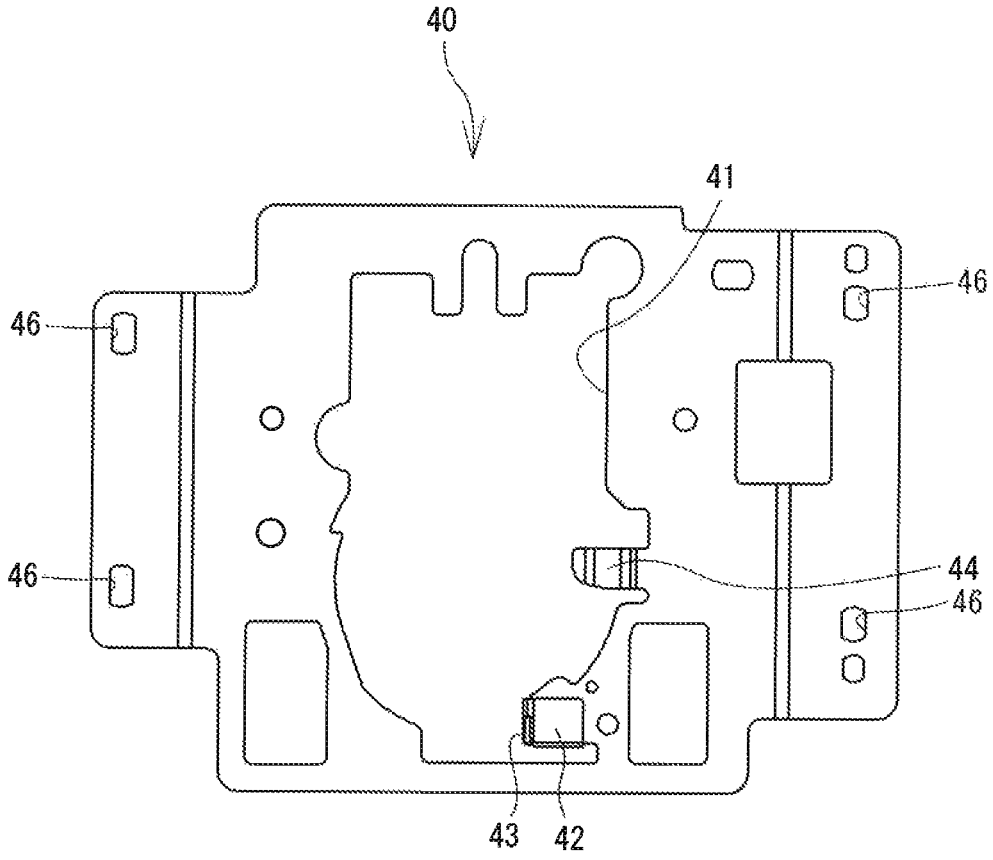
FIG. 7 is a plan view of a cover member 40.

The cover member 40 will be explained. As shown in FIG. 3, the cover member 40 is a metal plate that is approximately rectangular in a plan view. The rigidity of the sewing machine module 8 is ensured by the joining of the plate-shaped cover member 40 to the frame 20. Steps are formed between the central portion and the left edge portion and the right edge portion of the cover member 40. The areas where holes 46, through which the screws 49 are passed, are formed (refer to FIG. 7) are slightly lower than the central portion. As shown in FIG. 7, an opening 41 for opening the area above the feed dog 69, the shuttle mechanism 90, and the like is formed in the central portion of the cover member 40. The rotation-stopping member 42 is provided on the right front side of the opening 41. The rotation-stopping member 42 is provided with a leaf spring 43 on its left edge. The locking portion 93 that is provided in the inner shuttle 92 of the shuttle mechanism 90 (refer to FIG. 3) comes into contact with the leaf spring 43 of the rotation-stopping member 42. The rotation of the inner shuttle 92 is accordingly locked by the rotation-stopping member 42, even if the outer shuttle 91 rotates. A hold-down member 44 is provided slightly to the rear of the rotation-stopping member 42. The hold-down member 44 projects toward the inside from the edge of the opening 41 and restricts the upward movement of the inner shuttle 92. In a state in which the inner shuttle 92 is properly mounted in the outer shuttle 91, a gap exists between the inner shuttle 92 and the hold-down member 44 through which the upper thread is able to pass. However, in a case where a problem occurs for some reason during sewing and the lower thread is pulled out to an abnormal degree, the inner shuttle 92 will sometimes move upward. At a time like this, the inner shuttle 92 comes into contact with the hold-down member 44, so any further upward shifting (upward movement) of the inner shuttle 92 is restricted. Thus, because the rotation-stopping member 42 and the hold-down member 44 are provided as integral parts of the cover member 40, the preventing of the rotation of the inner shuttle 92 and the restricting of the upward movement of the inner shuttle 92 are both accomplished just by the joining of the cover member 40 to the frame 20.

As explained above, in the sewing machine module 8, the frame 20 is formed such that the frame 20 encloses the side faces and the bottom faces of the feed mechanism 60 and the shuttle mechanism 90. The top side of the frame 20 is open. The operator is therefore able to attach the members that form the feed mechanism 60, the shuttle mechanism 90, and the like to the frame 20 from above the frame 20. In a state in which the feed mechanism 60 and the shuttle mechanism 90 have been attached to the frame 20, the rigidity of the entire sewing machine module 8 is ensured by using the screws 49 to join the cover member 40 and the frame 20. The operator is therefore easily able to manufacture the sewing machine module 8 such that the sewing machine module 8 is provided with high rigidity. More specifically, there is no need to create a base for the mounting of the feed mechanism 60, the shuttle mechanism 90, and the like by bending a metal plate. It is also not necessary for the operator to attach members to a base from a plurality of directions. The sewing machine module 8 can thus be manufactured with high rigidity easily and at a low cost.

The urging portion 116 urges the feed bar 67 downward by coming into contact with the bottom face of the cover member 40. Therefore, the state of contact between the up-down feed lever 83 and the up-down feed cam 53 is maintained, and the feed bar 67 is swung upward and downward smoothly, just by the joining of the cover member 40 to the frame 20. The operator can thus easily manufacture the sewing machine module 8 such that the feed bar 67 swings smoothly.

The operator is able to adjust the position of the feed bar 67 by turning the adjusting screw 100 to adjust the distance between the up-down feed lever 83 and the feed bar 67. Furthermore, the leaf spring 105, which is urged toward the adjusting screw 100, restricts the rotation of the adjusting screw 100. Therefore, with a simple structure, the sewing machine module 8 is able to prevent the position of the feed bar 67 from being changed by the unintentional rotating of the adjusting screw 100 by the operator.

In the present embodiment, the spring cover 110, which covers the compression spring 114, comes into contact with the bottom face of the cover member 40. Therefore, falling of and damage to the compression spring 114 are prevented, as are similar problems, unlike in a case where the compression spring 114 makes direct contact with the cover member 40. Moreover, no damage is done to the bottom face of the cover member 40 by the compression spring 114. The sewing machine module 8 can therefore operate smoothly. In addition, the contact portion 112 of the spring cover 110 has a curved shape that protrudes upward. The spring cover 110 is therefore able to slide more smoothly against the cover member 40.

In the present embodiment, the feed arm 61 and the feed bar 67 are coupled by the coupling members 73. The locking portions 76 of the coupling members 73 allow the movements by which the shaft portions 75 are inserted into the holes 65 and the holes 71, and the locking portions 76 are locked to the beam portions 70 in a state in which the shaft portions 75 extend through the holes 65 and the holes 71. Therefore, unlike in a case where retaining rings or the like are used, the operator can easily couple the feed arm 61 and the feed bar 67 simply by pushing the shaft portions 75 of the coupling members 73 into the holes 65 and the holes 71. The operator can also easily release the coupling by undoing the locking of the locking portions 76.

In the present embodiment, the rotation-stopping member 42 and the hold-down member 44 are provided as integral parts of the cover member 40. Therefore, the locking of the rotation of the inner shuttle 92 and the restricting of the upward movement of the inner shuttle 92 are easily accomplished simply by joining the cover member 40 to the frame 20. Because the number of parts is less than in the known sewing machine module, the manufacturing cost and the operating burden are further reduced.

In the present embodiment, the frame 20 is formed from a synthetic resin material, and the cover member 40 is formed from a metal plate. The forming of the frame 20 from the synthetic resin material makes it possible for the operator to manufacture the frame 20, which is designed to allow many parts to be mounted from above, easily and at low cost. In contrast, a metal plate with high rigidity is used for the cover member 40, so the rigidity of the entire sewing machine module 8 can be enhanced by the joining of the frame 20 and the cover member 40. Moreover, because the cover member 40 has a substantially flat plate shape, processes such as complex bending and the like of the metal plate are not required.

The present disclosure is not limited to the embodiment that is described above, and various types of modifications can be made. For example, in the embodiment that is described above, the frame 20 is formed from a synthetic resin material. The frame 20 can therefore easily be created with a complex shape. However, the frame 20 may also be formed from a material other than a synthetic resin material. Furthermore, in the embodiment that is described above, the cover member 40 is formed from a metal plate with high rigidity, so the rigidity of the entire sewing machine module 8 is ensured. However, the material of the cover member 40 may also be changed. In the embodiment that is described above, it is also desirable for the rotation-stopping member 42 and the hold-down member 44 to be provided as integral parts of the cover member 40. However, at least one of the rotation-stopping member 42 and the hold-down member 44 may also be provided as a separate member.

In the embodiment that is described above, some of the areas to the sides and below the feed mechanism 60 and the shuttle mechanism 90 are covered by the frame 20, while other areas are left open. However, the entire area to the sides and below the feed mechanism 60 and the shuttle mechanism 90 may also be covered by the frame 20. In that case, the rigidity is improved even more. Furthermore, in the embodiment that is described above, the cover member 40 is joined to the frame 20 by the screws 49. Therefore, the frame 20 and the cover member 40 can be joined easily and strongly, and the joining can be easily undone. However, the frame 20 and the cover member 40 may also be joined by snap fits, welding or the like.

In the embodiment that is described above, the up-down feed lever 83 comes into contact with the up-down feed cam 53. However, one of a portion of the feed bar 67 and a member that is fixed to the feed bar 67 (for example, the adjusting screw 100) may also come into direct contact with the up-down feed cam 53. Even in that case, the feed bar 67 will swing up and down smoothly.

In the embodiment that is described above, the urging portion 116 is configured using the spring cover 110 and the compression spring 114. However, as long as the spring cover 110 covers at least the end of the compression spring 114 on the side toward the cover member 40, it is not necessary for the spring cover 110 to cover the entire compression spring 114. A leaf spring may also be used instead of the compression spring 114. In a case where a leaf spring is used, it is also acceptable for the spring cover 110 not to be used.

In the embodiment that is described above, the spring cover 110 is fitted over the threaded portion 101 of the adjusting screw 100, so the up-and-down movement of the spring cover 110 is guided smoothly by the threaded portion 101. However, the urging portion 116 may also be provided in a position other than the position of the adjusting screw 100. In the embodiment that is described above, the lower end of the compression spring 114 is in contact with the top face of the feed bar 67, so the feed bar 67 is urged downward. However, it is also acceptable for the compression spring 114 not to be in contact with the feed bar 67. For example, the compression spring 114 may also downwardly urge the feed bar 67, to which the adjusting screw 100 is attached, by coming into contact with the adjusting screw 100 and urging the adjusting screw 100 downward. In other words, the wording "the compression spring that is provided on the feed bar" is not wording that is intended to be limited to a case in which the compression spring is in contact with the feed bar.

In the embodiment that is described above, the rotation of the adjusting screw 100 is restricted by the contact of the projecting portion 106 of the leaf spring 105 with the knurling on the flange portion 102 of the adjusting screw 100. However, the structure for restricting the rotation of the adjusting screw 100 may also be modified. For example, the flange portion 102 of the adjusting screw 100 may be omitted, and the leaf spring 105 may be made to come into direct contact with the threaded portion 101 of the adjusting screw 100. In a case where the flange portion 102 is provided, it may also be provided above the feed bar 67 instead of below the feed bar 67. The projecting portion 106 of the leaf spring 105 may also be omitted. The rotation of the adjusting screw 100 may also be restricted by using a member other than the leaf spring 105 to apply a force to the adjusting screw 100.

The structures of the coupling members 73, the method of using the coupling members 73 for coupling the feed arm 61 and the feed bar 67, and the like can be modified as desired. For example, in the embodiment that is described above, the coupling members 73 are inserted into the holes 65 and the holes 71 from the outer sides on the left and the right. However, the coupling members 73 may also be mounted from the inner sides. In the embodiment that is described above, two of the locking portions 76 are provided on each of the coupling members 73, but the number of the locking portions 76 can also be changed.

What is claimed is:

1. A sewing machine module that is mounted in a sewing machine, comprising:

a feed mechanism;

a shuttle mechanism;

a frame that covers at least a portion of a side face of the feed mechanism, a portion of a side face of the shuttle mechanism, a portion of a bottom face of the feed mechanism, and a portion of a bottom face of the shuttle mechanism and that supports the feed mechanism and the shuttle mechanism in a state in which a top side of the feed mechanism and a top side of the shuttle mechanism are open;

a cover member that is formed into a flat plate shape and that covers the top side of the feed mechanism and the top side of the shuttle mechanism that are supported by the frame; and a joining mechanism that joins the frame and the cover member, wherein the feed mechanism includes a feed dog, a feed bar that supports the feed dog and is configured such that the feed dog swings up and down, a lower shaft that is supported by the frame below the feed bar and is configured such that the lower shaft rotates, an up-down feed cam that is fixed to the lower shaft, an urging mechanism that is provided on the feed bar, that is in contact with a bottom side of the cover member, and that urges the feed bar downward, and a contacting element that maintains a state of contact with the up-down feed cam, such that the feed bar is urged downward by the urging mechanism, and that, by swinging in conjunction with rotation of the up-down feed cam, causes the feed bar to swing up and down.

2. The sewing machine module according to claim 1, further comprising:

an adjusting screw that is provided in the feed bar and that adjusts a distance between the contacting element and the feed bar; and a leaf spring that is urged such that the leaf spring is in contact with and presses against the adjusting screw and that restricts rotation of the adjusting screw.

3. The sewing machine module according to claim 1, wherein the urging mechanism includes a compression spring that is provided on the feed bar, and a spring cover that covers at least an end portion of the compression spring on the side toward the cover member and that is urged by the compression spring such that the spring cover is in contact with and presses against the cover member.

4. The sewing machine module according to claim 3, wherein the spring cover includes a contact portion that has a curved shape that protrudes upward and that is in contact with the bottom side of the cover member.

5. The sewing machine module according to claim 1, wherein the feed mechanism further includes a feed arm that supports the feed bar and is configured such that the feed bar swings, and a coupling member that couples the feed arm and the feed bar and is configured such that the feed arm and the feed bar swing, and the coupling member includes a shaft portion that extends through a first hole that is formed in the feed bar and a second hole that is formed in the feed arm, and a locking portion that has flexibility, that allows the shaft portion to move such that the shaft portion is inserted into the first hole and the second hole, and that is locked to at least one of the feed bar and the feed arm in a state in which the shaft portion extends through the first hole and the second hole.

6. A sewing machine module that is mounted in a sewing machine, comprising:

a feed mechanism a shuttle mechanism;

a frame that covers at least a portion of a side face of the feed mechanism, a portion of a side face of the shuttle mechanism, a portion of a bottom face of the feed mechanism, and a portion of a bottom face of the shuttle mechanism and that supports the feed mechanism and the shuttle mechanism in a state in which a to side of the feed mechanism and a to side of the shuttle mechanism are open;

a cover member that is formed into a flat plate shape and that covers the top side of the feed mechanism and the top side of the shuttle mechanism that are supported by the frame; and a joining mechanism that joins the frame and the cover member, wherein the shuttle mechanism includes an outer shuttle that grips a thread, and an inner shuttle that is fitted into an inner side of the outer shuttle in a state in which the inner shuttle is rotatable in relation to the outer shuttle, and wherein the cover member includes a rotation-stopping member and a hold-down member as integral parts of the cover member, the rotation-stopping member coming into contact with a portion of the inner shuttle and locking the rotation of the inner shuttle, and the hold-down member restricting upward movement of the inner shuttle.

7. A sewing machine module that is mounted in a sewing machine, comprising:

a feed mechanism;

a shuttle mechanism a frame that is formed from a synthetic resin material and that covers at least a portion of a side face of the feed mechanism, a portion of a side face of the shuttle mechanism, a portion of a bottom face of the feed mechanism, and a portion of a bottom face of the shuttle mechanism and that supports the feed mechanism and the shuttle mechanism in a state in which a top side of the feed mechanism and a top side of the shuttle mechanism are open;

a cover member that is formed from a metal plate into a flat plate shape and that covers the top side of the feed mechanism and the top side of the shuttle mechanism that are supported by the frame; and a joining mechanism that joins the frame and the cover member.

* * * * *